United States Patent [19]

Brundbjerg et al.

[11] Patent Number: 4,906,529

[45] Date of Patent: Mar. 6, 1990

[54] METHOD OF PRODUCING AN EROSION-RESISTANT SURFACE/LAYER ON A METALLIC WORKPIECE

[75] Inventors: Niels Brundbjerg, Gentofte, Denmark; Wolfgang Simm, Ecublens, Switzerland

[73] Assignee: Castolin S.A., St-Sulpice, Switzerland

[21] Appl. No.: 18,487

[22] Filed: Feb. 4, 1987

[30] Foreign Application Priority Data

Feb. 5, 1986 [CH] Switzerland ..... 437/86

[51] Int. Cl.[4] ..... B22F 3/00

[52] U.S. Cl. ..... 428/552; 419/8; 419/54; 419/57; 419/58; 419/12; 419/17; 419/18; 427/191; 428/553; 428/564; 428/680; 428/220; 428/908.8

[58] Field of Search ..... 419/8, 57, 58, 54, 12, 419/17, 18; 427/191; 428/552, 553, 564, 680, 908.8, 220

[56] References Cited

U.S. PATENT DOCUMENTS 3,961,098 6/1976 Bessen ..... 427/34

3,991,240 11/1976 Harrington et al. ..... 427/423

4,173,685 11/1979 Weatherly ..... 428/556

*Primary Examiner*—Stephen J. Lechert, Jr.

*Attorney, Agent, or Firm*—Hopgood, Calimafde, Kalil, Blaustein & Judlowe

[57] ABSTRACT

A method is provided for producing an erosion-resistant layer or coating on the surface of a metallic workpiece. The method includes providing a thermally sprayable alloy of Ni-Cr-Fe-B-Si and thermally spraying the alloy on the workpiece to a specified thickness, following which the sprayed-on layer is heated in vacuum to a temperature between 250° C. to 400° C. for a time at the stated temperature of about 5 to 30 minutes sufficient to effect degassing of the layer. The temperature of the layer is thereafter raised to a range of about 800° C. to 950° C. and maintained at that temperature in vacuum for between 5 to 30 minutes. The temperature at the layer is then raised to between 900° C. and 1100° C. under a protctive atmoshpere at a pressure of between 200 to 600 mm Hg to effect fursion of the layer at above its melting point, following which the coated metallic workpiece is finally cooled to room temperature under the protective atmosphere.

8 Claims, No Drawings

METHOD OF PRODUCING AN EROSION-RESISTANT SURFACE/LAYER ON A METALLIC WORKPIECE

The present invention relates to a method of producing an erosion-resistant surface layer on a metallic workpiece.

The layers produced in accordance with the usual methods of this type exhibit a relatively high porosity as well as an elasticity which is insufficient for certain applications and thus an insufficient resistance against loading by mechanical vibrations. The porosity of the surface layers made up to now is a drawback in particular for parts which are exposed to gas or air streams containing particles such as dust particles, since the resulting wear by erosion may be very important. This can be observed for example on edge parts of aircraft flying at high speeds or of rotary wing aircraft, in particular when they are used for flights near the ground. Attempts to make those parts wear-resistant by using for example austenitic stainless steel sheet material of 1,0 to 1,5 mm thickness, as well as subsequent hard chrome plating, provided in certain cases a life of about 10 hours only. Even protective surface layers produced by thermal spraying did not lead to better results due to the above-mentioned inconveniences.

It is an object of the invention to provide a method allowing to produce highly pore-free and thus particularly erosion-resistant surface layers which, in addition, exhibit a high resistance against mechanical vibrations.

This is achieved according to the invention by employing the steps set forth in the claims.

The method according to the invention will now be described and explained in greater detail by way of examples.

EXAMPLE 1

On the surface of an aircraft wing flap of austenitic sheet steel 18/8 with a thickness of 2.5 mm, a protective layer of 500 um thickness has been produced in accordance with the invention, as follows:

(a) Preparation:

The surface to be coated was sandblasted with corundum of a grain size of 0.5 to 1.0 mm so as to obtain a surface roughness of Ra 15 to 20 μm.

(b) Spraying material:

The material applied was a mixture of 50 percent by weight of a matrix alloy and 50 percent by weight of WC/Co as hard cemented material. The matrix alloy was composed of 0.5 to 1.0 C, 14.0 to 16.0 Cr, 2.0 to 4.0 Fe, 2.5 to 4.0 B, 3.0 to 5.0 Si, remainder Ni, and the WC/Co contained 85 to 90 WC and 15 to 10 Co (amounts indicated in percent by weight).

(c) Spraying parameters:

An autogeneous flame spray torch of the type ROTOTEC 80 of Castolin S.A. was used under the following conditions: oxygen pressure 4.0 bar, acetylene pressure 0.8 bar, flame adjustment neutral, spraying distance 160 to 200 mm, powder feeding rate 5 kg/h. The thickness of the sprayed layer was 650 μm.

(d) Heat treatment (fusing):

The wing was placed in a furnace for thermal treatment and the pressure therein was then lowered down to $10^{-3}$ torr by pumping. Next, the workpiece was heated up to between 250° and 350° C. and kept during 15 to 30 minutes at that temperature, thus degassing the sprayed layer. Then the workpiece was further heated up to a temperature of between 800° and 900 ° C. and kept at this temperature, still at $10^{-3}$ torr during a period of between 10 to 20 minutes. This produced a degassing of the molten alloy bath. Then, the temperature was further raised and, at a temperature between 920° and 960 ° C., argon was introduced in the furnace and an argon pressure of 400 to 600 mm Hg was built up in place of the vacuum. Subsequently the workpiece was heated with doubled heating power up to a temperature between 1040° and 1050° C. Then the workpiece was allowed to cool down to about 800° C. and, at this temperature, the protective argon atmosphere was exchanged against nitrogen at a pressure of 600 mm Hg, thus facilitating the cooling down to room temperature.

After the above fusing process the thickness of the layer was 500 μm.

When using the so coated part, the life thereof appeared to be more than 8 times longer than that of the uncoated part.

EXAMPLE 2

On the surface of a wing edge part made from 18/8 Molybdenum-steel sheet of 2.0 mm thickness, a layer of 300 μm thickness was produced as follows:

(a) Preparation as in Example 1.

(b) Spraying material:

A mixture of 70 percent by weight matrix alloy and 30 percent by weight of carbides was used wherein the matrix alloy had the following composition: 0.8 to 1.2 C, 24.0 to 25.0 Cr, 0.5 to 2.5 Fe, 3.2 to 4.2 B, 3.5 to 5.0 Si, remainder Ni, and the carbides were a mixture of 15.0 to 20.0 TiC, 15.0 to 20.0 TaC, remainder WC (amounts indicated in percent by weight).

(c) Spraying parameters:

The spraying parameters of Example 1 were again used except for the following changes:

Spraying distance 160 to 180 mm, powder feeding rate 6.2 kg/h.

The thickness of the layer after the spraying was 380 μm.

(d) Heat treatment (fusing process):

After having placed the workpiece in a furnace and evacuating the same down to a pressure of $10^{-3}$ torr, the temperature was first raised up to between 300° and 350° C. and kept at this value during 15 to 30 minutes. Then the temperature was raised up to 900° C. and kept at that value during 15 to 20 minutes. When further heating up, helium was used as a protective gas in place of the vacuum at a pressure of 400 mm Hg. Subsequently the temperature was brought up to a value between 1050° and 1060° C. by using double heating power and the peak value of the temperature was maintained during 2 minutes: Then the workpiece was allowed to cool down to 900° C., the protective atmosphere was changed and the further cooling took place under argon at a pressure of 600 mm Hg.

The thickness of the layer after this fusing treatment was 300 μm.

The thus achieved life of the part again appeared to be a multiple of the life of the uncoated part.

EXAMPLE 3

On a workpiece which was intended for use at high wind velocities in presence of fine dust particles and the base material of which was austenitic stainless steel plate of 1.0 mm thickness, a protective layer of 200 μm thickness was produced as follows:

(a) Preparation as in Example 1.

(b) Spraying material:

A mixture of 62 percent by weight of matrix alloy and 38 percent by weight of CrB was used, wherein the matrix alloy had the following composition: 0.8 to 1.0 C, 16.0 to 18.0 Cr, 5.0 to 8.0 Fe, 2.5 to 3.5 B, 3.0 to 4.0 Si, remainder Ni (amounts indicated in percent by weight).

(c) Spraying parameters as in Example 2.

(d) Heat treatment (fusing process):

The workpiece was first clamped in a clamping device to avoid possible distortion and then place together with the clamping device in a vacuum furnace at room temperature. After evacuating the air down to a pressure of $10^{-3}$ torr, followed heating up to a temperature between 250° and 300° C. At this temperature a holding period of 10 to 15 minutes was observed and subsequently further heating up to 900° C. was effected slowly to allow the temperature to equalize with the clamping device. The temperature of 900° C. was maintained during 10 to 15 minutes and then raised up to a value between 920° and 950° C. At this temperature argon was introduced in place of the vacuum, at a pressure of 300 to 400 mm Hg. Further on, the heating was effected with double heating power up to between 1030° and 1040° C. Finally, the workpiece was allowed to cool down in argon to room temperature.

The obtained layer of 200 um thickness appeared to be extremely erosion-resistant and also resistant against alternating mechanical load to which it was submitted in practice.

EXAMPLE 4

A similar part as in Example 3, made of 18/8 steel plate of 1.5 mm thickness, was provided with a surface layer of 150 μm. The method was similar to that of Example 3, except that the spraying material was an alloy of the following composition: 0.5 to 0.9 C, 24.0 to 26.0 Cr, 0.2 to 1.0 Fe, 3.5 to 4.0 B, 3.6 to 4.5 Si, remainder Ni.

This coating also produced a practically completely pore-free, extremely wear resistant and mechanically stable protective layer.

It becomes apparent from the above in particular that in the heat treatment according to the invention, contrarily to the usual methods, holding times are intercalated at two different temperature levels during the heating up and that furthermore in the range from 900° to 1000° C. a protective atmosphere is introduced which is effective against the evaporation of boron. The coating alloys used have a hardness of more than 50 $H_{Rc}$ preferably of more than 55 $H_{Rc}$.

By the method according to the invention substantially pore-free layers of very good mechanical resistance are obtained allowing in the first place to reach a very high erosion resistance with sufficient elasticity of the layer.

We claim:

1. A method for producing an erosion-resistant layer or coating on the surface of a metallic workplace which comprises:

providing a thermally sprayable alloy of Ni-Cr-Fe-B-Si and thermally spraying said alloy on said workpiece to a thickness of 10 to 500 μm, heating said sprayed-on layer in vacuum to a temperature between 250° C. to 400° C. for a time at said temperature between 5 and 30 minutes sufficient to effect degassing of said layer, raising the temperature of a said layer thereafter to a range of 800° C. to 950° C. and maintaining said temperature at said range in said vacuum for between 5 to 30 minutes, further raising the temperature of said layer to between 900° C. and 1100° C. under a protective atmosphere at a pressure of between 200 to 600 mg Hg to effect fusion of said layer at above its melting point, and then finally cooling the coated metallic workpiece to room temperature under said protective atmosphere.

2. The method according to claim 1, wherein the layer is thermally sprayed to a thickness of between 20 to 360 μm.

3. The method of claims 1 or 2, wherein the alloy sprayed on the workpiece has the following composition by weight: 0.5 to 1.5% C, 10 to 26% Cr, 1.5 to 10% Fe, 1.5 to 4.5% B, 2.5 to 5% Si, and the remainder essentially Ni.

4. The method of claim 3, wherein the sprayed layer includes in the alloy hard metal compounds in the amount of 10 to 70% by weight of the layer.

5. The method of claim 4, wherein the hard metal compound is selected from the group consisting of carbides and borides of Cr, Ti, W, Ta, Mo and Nb.

6. The method of claim 5, wherein the hard metal compound is tungsten carbide mixed with 4 to 20% by weight of cobalt.

7. The method of claim 1, wherein the protective atmosphere is selected from the group consisting of nitrogen, helium and argon; and wherein the pressure of the protective atmosphere is between 300 and 600 mm Hg.

8. An erosion-resistant surface layer produced in accordance with the methods of any one of the claims 1 to 7.

* * * * *